US006111957A

United States Patent [19]

Thomasson

[11] Patent Number: 6,111,957

[45] Date of Patent: Aug. 29, 2000

[54] APPARATUS AND METHOD FOR ADJUSTING AUDIO EQUIPMENT IN ACOUSTIC ENVIRONMENTS

[75] Inventor: Samuel L. Thomasson, Gilbert, Ariz.

[73] Assignee: Acoustic Technologies, Inc., Mesa, Ariz.

[21] Appl. No.: 09/109,847

[22] Filed: Jul. 2, 1998

[51] Int. Cl.[7] ..... H04H 5/00; H04R 29/00

[52] U.S. Cl. ..... 381/15; 381/56; 381/58; 381/103

[58] Field of Search ..... 381/15, 26, 56, 381/57, 58, 59, 74, 83, 92, 93, 95, 96, 103, 111, 122

[56] References Cited

U.S. PATENT DOCUMENTS

| | | | |
|---|---|---|---|
| 3,732,370 | 5/1973 | Sacks | 179/1 D |
| 4,628,530 | 12/1986 | Op De Beek et al. | 381/103 |
| 4,694,498 | 9/1987 | Suzuki et al. | 381/59 |
| 5,386,478 | 1/1995 | Plunkett | 381/103 |
| 5,412,734 | 5/1995 | Thomasson | 381/83 |
| 5,649,019 | 7/1997 | Thomasson | 381/83 |
| 5,694,476 | 12/1997 | Klippel | 381/96 |
| 5,768,398 | 6/1998 | Janse et al. | 381/103 |
| 5,796,847 | 8/1998 | Kaihotsu et al. | 381/57 |
| 5,915,029 | 6/1999 | Yazurlo et al. | 381/58 |

FOREIGN PATENT DOCUMENTS

| | | | |
|---|---|---|---|
| 55-112097 | 8/1980 | Japan | 381/56 |

*Primary Examiner*—Forester W. Isen
*Assistant Examiner*—Xu Mei
*Attorney, Agent, or Firm*—Paul F. Wille

[57] ABSTRACT

The signal in each channel of a stereo is modulated at an inaudible frequency by a replica of the original signal. The modulated signal is broadcast into a room by a loudspeaker and is picked up by a microphone. The microphone is coupled to the stereo, which includes a demodulator for separating the replica from the signal as received at the microphone. By comparing the replica with the demodulated signal, data is extracted to compensate for the acoustic characteristics of the loudspeaker and the room in which the loudspeaker is located.

10 Claims, 2 Drawing Sheets

APPARATUS AND METHOD FOR ADJUSTING AUDIO EQUIPMENT IN ACOUSTIC ENVIRONMENTS

BACKGROUND OF THE INVENTION

This invention relates to circuits for adjusting the frequency response and other parameters of a high fidelity audio system and, particular, to a circuit for performing such adjustment automatically without special test conditions.

The quest for better fidelity in audio systems began with Thomas A. Edison and will probably continue forever, partly because the word "fidelity" is somewhat subjective. As used herein, fidelity relates to how accurately the sound adjacent a listener's ear corresponds to an electrical signal derived from a source of program material such as a microphone, a phonograph record, a compact disk, or a magnetic tape.

It has long been recognized in the art that distortions can arise not only in the electrical signal but in the loudspeakers and in a room itself. Typically, the prior art provides a compensating system including an equalizer (or a "graphic equalizer"), a microphone, and a spectrum analyzer. A test signal, such as "pink" noise or pulses, is converted into sound by the loudspeakers and the microphone converts the sound to an electrical signal for analysis. The equalizer is adjusted to minimize the unevenness in frequency response caused by the loudspeakers and by the acoustics of the room in which the test takes place. U.S. Pat. No. 3,732,370 (Sacks) discloses such a system.

U.S. Pat. No. 5,386,478 (Plunkett) describes a system in which a microphone senses a test signal from individually driven speakers and provides control information to a command module for adjusting an equalizer in a stereo.

While not discussed in the prior art, such compensating circuits are somewhat fastidious. For example, the room must be silent during a test. Any noise, i.e. any sound other than the test signal, interferes with and obviates the test. The room should be set up as it will be during use, including the location of furniture and the number of people. The test signal must be listened to in silence by the occupants of the room during a test. One can imagine listening to pink noise, which sounds like inter-channel hiss in an FM radio, or to pulses (popping noises), as the system is tested, speaker by speaker, frequency band by frequency band. Any substantial change in the listening environment, such as opening or closing draperies, requires that the test be performed again, which may not be convenient.

In a compensating system such as described in the Sacks patent, the system attempts to flatten the frequency response of the room acoustics, including the loudspeakers, by increasing or decreasing the amplitude in certain band. A listener who prefers or needs mid-range frequencies boosted is unable to make the necessary corrections without nullifying the settings determined by the test or, perhaps, making the system sound worse than before the test.

Compensating systems of the prior art are expensive. While such systems could be used to improve the fidelity of inexpensive stereo systems, one would be in the anomalous position of spending several times the cost of the stereo on a circuit to improve the sound of the stereo. As used herein, "stereo" is generic for a high fidelity audio system, regardless of the actual number of channels or speakers.

The prior art typically describes a compensating system that is in addition to an existing stereo. As audio systems becomes more compact, such additional equipment becomes aesthetically displeasing.

It is known in the art to modulate an audible sound with an inaudible sound for detecting feedback in audio systems. As disclosed in U.S. Pat. No. 5,649,019 (Thomasson), the inaudible sound is a replica of the original sound. If feedback occurs, the replica is recovered and is used to reduce the amplitude of the echo.

In view of the foregoing, it is therefore an object of the invention to provide an apparatus and a method for automatically adjusting a high fidelity sound system for room acoustics without a test signal.

A further object of the invention is to provide a compensating circuit that allows tone preferences.

Another object of the invention is to provide a compensating circuit that produces a sound at a location in a room that accurately represents an electrical signal derived from a source, even if the electrical signal includes modifications by a tone control circuit such as a single band filter or an equalizer having several bands.

A further object of the invention is to provide a compensating circuit that is transparent to a user during operation.

Another object of the invention is to provide a compensating circuit that can be incorporated into relatively inexpensive stereo systems.

A further object of the invention is to provide a technique for automatically adjusting a high fidelity sound system that is easily implemented in semiconductor devices incorporated into the sound system.

SUMMARY OF THE INVENTION

The foregoing objects are achieved by this invention in which the signal in each channel of a stereo is modulated at an inaudible frequency by a replica of the original signal. The modulated signal is broadcast into a room by a loudspeaker and is picked up by a microphone. The microphone is coupled to the stereo, which includes a demodulator for separating the replica from the signal as received at the microphone. By comparing the replica with the demodulated signal data is extracted to compensate for the acoustic characteristics of the loudspeaker and the room in which the loudspeaker is located.

BRIEF DESCRIPTION OF THE DRAWINGS

A more complete understanding of the invention can be obtained by considering the following detailed description in conjunction with the accompanying drawings, in which.

DETAILED DESCRIPTION OF THE INVENTION

Figure 1:
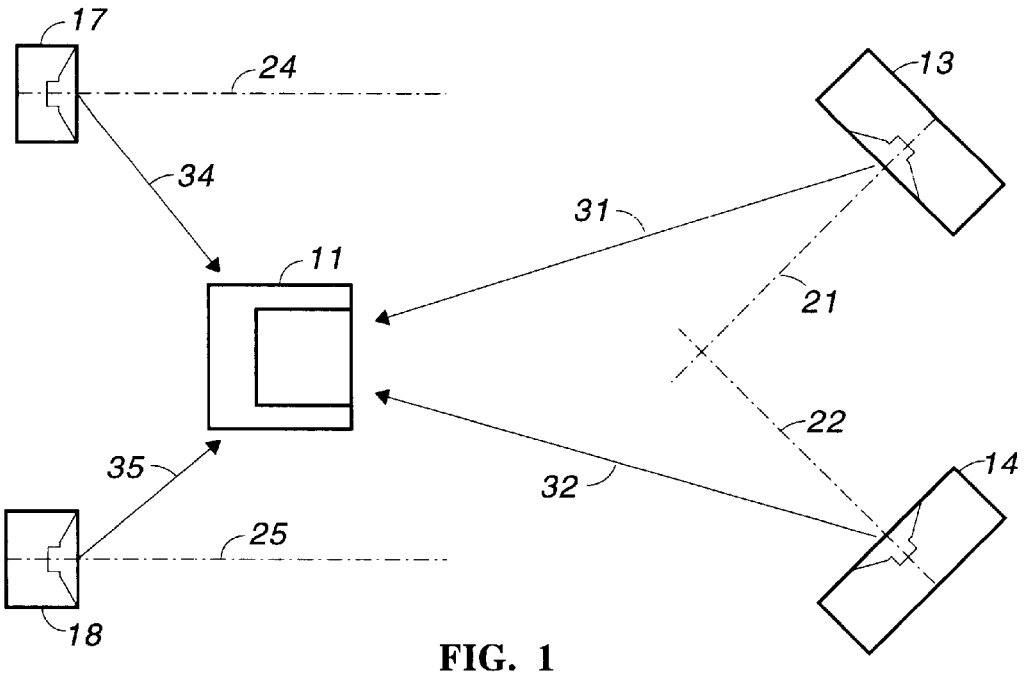
FIG. 1 illustrates a listening position placed asymmetrically in a room with four speakers.

In FIG. 1, armchair 11 is positioned asymmetrically among front speakers 13 and 14 and rear speakers 17 and 18. Axis 21 of speaker 13 intersects axis 22 of speaker 14 in front of armchair 11, which is usually considered a less than desirable arrangement because stereo separation is reduced.

Any position off-axis tends to reduce higher frequencies more than lower frequencies, slightly "deadening" the sound from the speakers. Axis 24 of speaker 17 and axis 25 of speaker 18 are approximately parallel and armchair 11 is substantially off-axis from these speakers.

Speakers 13, 14, 17, and 18 are preferably the same make and model but need not be for use in this invention. The compensation provided by the invention can overcome differences in frequency response among similar speakers. Obviously, one simply cannot obtain the same bass response from a speaker element four inches in diameter as one obtains from a speaker element fifteen inches in diameter.

Paths 31, 32, 34, and 35 are the direct paths to a listener seated in armchair 11 but these are not the only paths, depending upon the acoustics of the room. The sound wave at the ear of a listener is a complex sum of components that sometimes constructively combine and sometimes destructively combine to produce the frequency response of the room at a particular location. As such, the frequency response can change greatly with a change in location. The invention enables one to quickly and easily compensate for room acoustics by simply pressing a button on a microphone held at the desired location.

Figure 2:
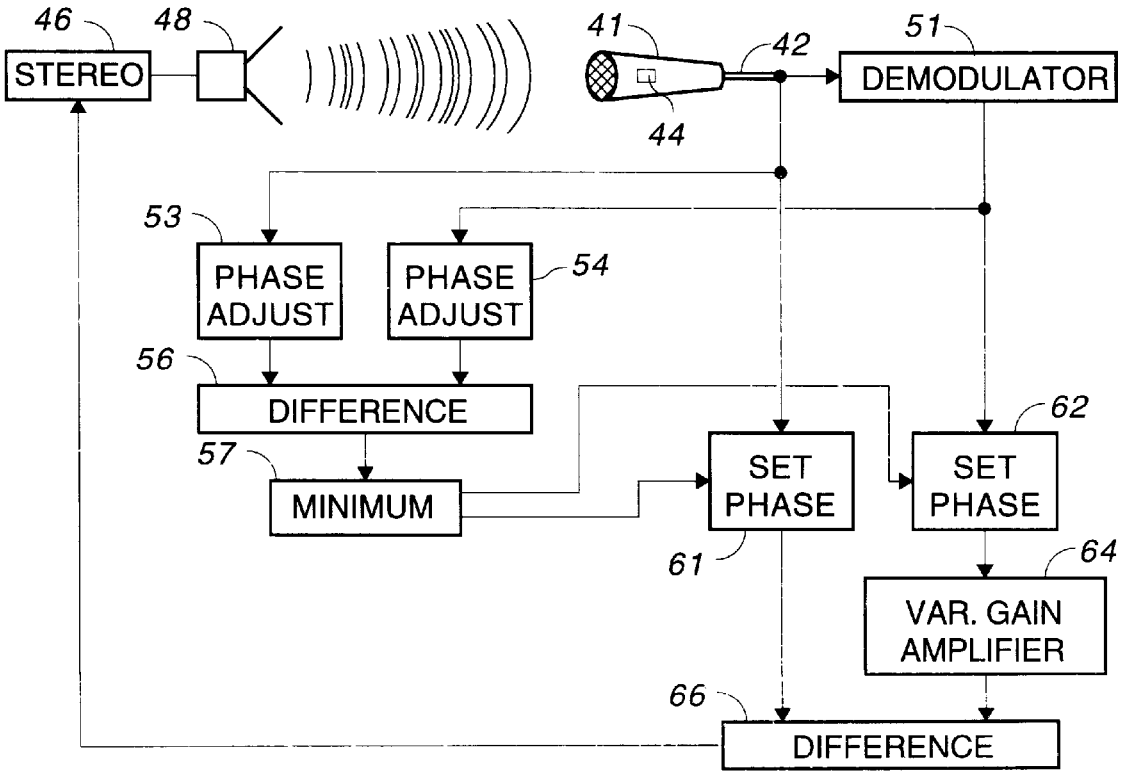
FIG. 2 is a block diagram of a compensating circuit constructed in accordance with a preferred embodiment of the invention.

In FIG. 2, microphone 41 is coupled to the compensating circuit through link 42, which is preferably an IR link but can be wireless or wire (coaxial cable). Microphone 41 includes button 44 for initiating testing in accordance with the invention. When button 44 is actuated, a control signal is transmitted by microphone 41, causing stereo 46 to drive speaker 48 with a signal that includes an audible carrier modulated with an inaudible replica of the carrier. The carrier is program material from a source and the replica is frequency modulated or pulse width modulated onto the carrier, as described in greater detail in connection with FIG. 3.

The modulated sound is converted back into an electrical signal by microphone 41 and transmitted over link 42 to demodulator 51. The input of demodulator 51 is coupled to phase adjusting circuit 53, shown in greater detail in FIG. 4. The output of demodulator 51 is coupled to phase varying circuit 54, which is constructed in the same manner as circuit 53. The outputs of circuits 53 and 54 are subtracted in difference amplifier 56 and minimum detector 57 marks the phase at which the difference between the replica and the modulated original signal is at a minimum. The phase information is coupled to phase adjusting circuits 61 and 62.

The signal directly from microphone 41 is coupled to phase adjusting circuit 61 and the replica from demodulator 51 is coupled to phase adjusting circuit 62. With the phase difference minimized, the amplitude of one of the signals, e.g. the replica, is varied until the difference is at a minimum. The gain of amplifier 64 is varied until the difference in amplitude between the replica and the modulated original signal is minimized. Difference data, from difference amplifier 66, is coupled to stereo 46 to control the gain of the amplifier in the channel under test.

Each channel of a stereo is tested in several bands dividing up the audible spectrum, e.g. 20 Hz. to 20 kHz., and each band is tested. The bands need not be tested in sequence. Each test lasts approximately fifty milliseconds. A two channel system with a ten band equalizer can be compensated in about one second.

Figure 3:
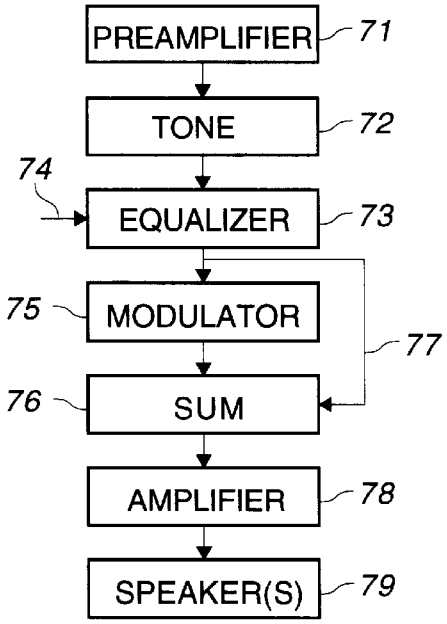
FIG. 3 is a block diagram of a system for modulating a signal in accordance with the invention.

FIG. 3 illustrates modulating a signal in accordance with the invention. A signal from a suitable source is amplified in preamplifier 71 and coupled through tone control circuit 72 and equalizer 73 to modulator 75. Tone control circuit 72 is accessible to a user and can be a single band circuit or an equalizer with a plurality of bands. Equalizer 73 is not accessible to the user and is controlled by a signal on input line 74 from difference amplifier 66 (FIG. 2). During a test, the gain of each filter circuit in equalizer 73 is adjusted according to the signal on line 74 for each channel (speaker) in an audio system. For ⅓ octave filters, there are thirty filters per channel.

One could combine circuits 72 and 73 but, preferably, they are separate. An advantage of having tone control circuit 72 ahead of equalizer 73 is that the signal into the equalizer can include any tonal preferences that a user might have and the compensation circuit will try to reproduce those preferences as faithfully as possible. Thus, the input to the equalizer is the original signal by which fidelity is measured. The compensation circuit tries to produce a sound at the ear of the user corresponding as closely as possible to the original signal, which may or may not result in linearizing the frequency response of a speaker or of a room.

The output from equalizer 73 is coupled throughe modulator 75 to summation circuit 76 and is coupled directly to the summation circuit. The signal on line 77 is the carrier and the signal from modulator 75 is the modulation. Modulator 75 converts the original signal into an inaudible replica that is pulse width modulated or frequency modulated onto the carrier. A typical center frequency for the replica is about 30 kHz. The output from summation circuit is amplified in power amplifier 78 and broadcast by speakers 79.

Figure 4:
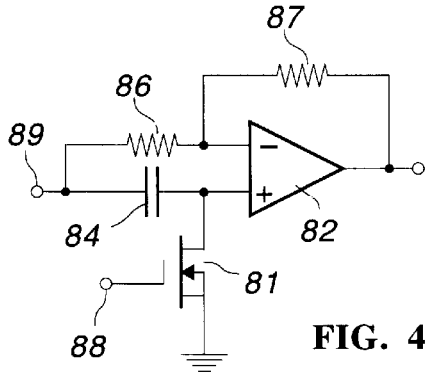
FIG. 4 is a schematic of an all-pass filter useful for varying the phase of a signal.
Figure 5:
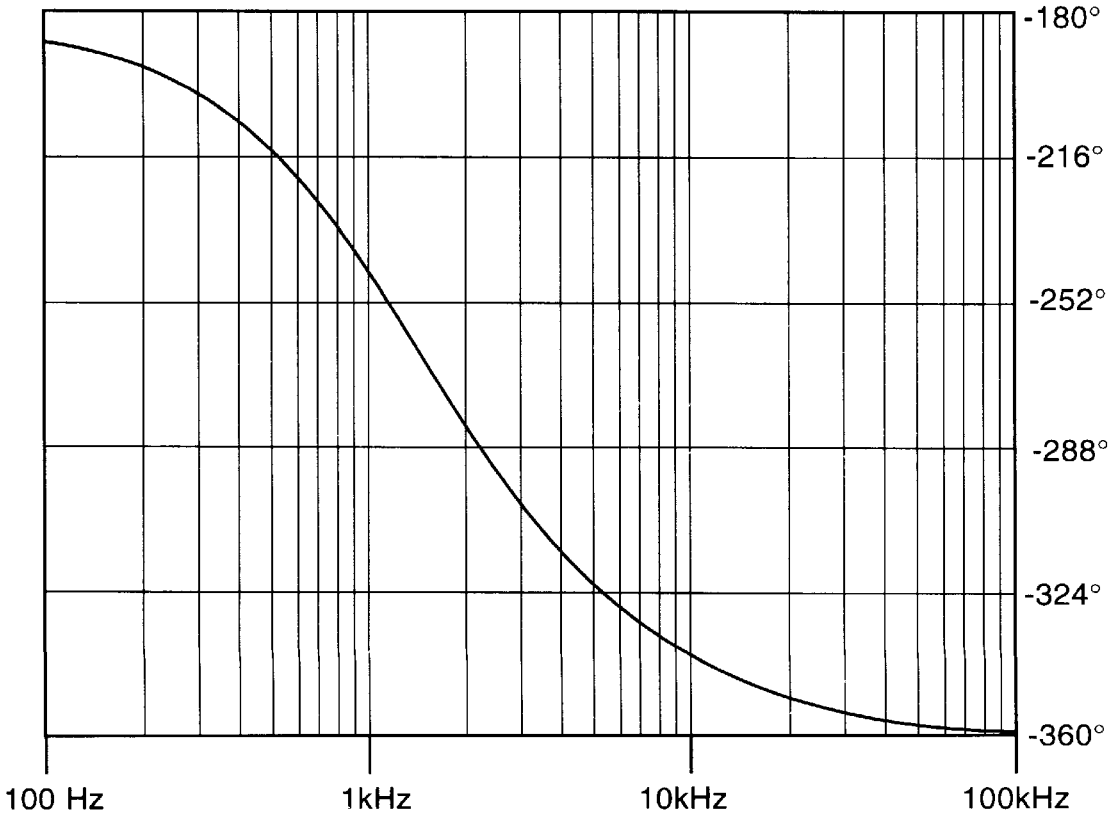
FIG. 5 is a chart of the phase shift characteristic of the circuit shown in FIG. 3.

FIG. 4 is a Butterworth filter, modified to provide a variable phase shift and used in phase adjusting circuits 53 and 54 (FIG. 2). In FIG. 4, transistor 81 acts as a variable resistor to change the RC time constant of the non-inverting input to amplifier. Capacitor 84 and transistor 81 are the RC circuit. Varying the resistance of transistor 81 shifts the inflection point of the characteristic curve of the circuit, illustrated in FIG. 5. The circuit of FIG. 4 has a flat frequency response but has a frequency dependent phase shift. As illustrated in FIG. 5, the phase shift is approximately 1800 at 100 Hz and is approximately 360° at 100 kHz.

In one embodiment of the invention, the elements of FIG. 5 had the following values, which are given by way of example only.

transistor 81 2N5457 (FET)
amplifier 82 LF347
capacitor 84 0.1 $\mu$f
resistors 86, 87 10 kΩ

In operation, a ramp voltage is applied to input 88 and the signal from microphone 41 (FIG. 2) is applied to input 89. A narrow range of frequencies is being tested, corresponding to one band of equalizer 73 (FIG. 3), which preferably has ⅓ octave filters. All bands, except the band of interest, are suppressed in equalizer 73 during a test.

Each of circuits 53 and 54 is constructed as illustrated in FIG. 4. The signals to one circuits is inverted to provide a 360° phase sweep. The ramp voltages applied to the circuits have opposite slope (one voltage decreases, the other voltage increases), which shortens the time required to find the phase difference between the signals. Once the phase difference is determined, the information is coupled to circuits 61 and 62, which include a phase shift circuit for each band of equalizer 73. The process is repeated for each speaker in the audio system and the results stored in memory, e.g. EEPROM, to survive power interruptions.

The invention thus provides a circuit for automatically adjusting high fidelity sound systems for distortions produced by the loudspeakers and by the room in which the loudspeakers are located. The compensating circuit that does not require a test signal for operation and the compensating circuit allows tone preferences to be faithfully reproduced by the speakers and room acoustics. The compensating circuit produces a sound at a location n a room that accurately represents an electrical signal derived from a source, even if the electrical signal has been modified by a tone control circuit such as a single band filter or an equalizer having several bands. The operation of the compensating circuit is transparent to a user during operation because only the channel under test is affected. The compensating circuit can be incorporated into relatively inexpensive stereo systems and is easily implemented in semiconductor devices incorporated.

Having thus described the invention, it will be apparent to those of skill in the art that various modifications can be made within the scope of the invention. The process is controlled by a microprocessor or by fixed logic, such as a programmable logic array. The ramp voltage need not be linear but could be sinusoidal, for example. The apparatus can be modified to measure delay but correcting for delay in a room less than fifty feet on a side is believed unnecessary. Because the ultrasonic modulation uniquely tags a sound, delay can be measured precisely without special test signals. Compensating for delay is fairly simple to implement in digital circuitry, e.g. by using volatile memory, but long delays are somewhat difficult to obtain from analog circuitry, such as bucket brigade devices. A loudspeaker incapable of producing ultrasonic signals, such as a sub-woofer, has no effect on the system. The lack of a received, modulated signal prevents changing an equalizer from the default settings (unity gain) at the beginning of a test. The system merely moves on to the next channel after testing the channel containing the sub-woofer. Although the invention obviates the need for a test signal, one could use a test signal if one wanted, e.g. for diagnosing equipment problems.

What is claimed as the invention is:

1. A method for adjusting audio equipment for acoustic environments, said method comprising the steps of:

broadcasting an audio signal having a carrier modulated by an inaudible replica of the carrier;

converting the audio signal into an electrical signal;

demodulating the electrical signal to recover the carrier and the replica;

comparing the carrier and the replica to determine phase delay and attenuation of the carrier; and adjusting said audio equipment to match phase delay and minimize attenuation.

2. The method as set forth in claim 1 wherein said carrier is program material.

3. The method as set forth in claim 1 wherein said carrier is a test signal.

4. The method as set forth in claim 1 wherein said comparing step includes the steps of:

minimizing the phase difference between the carrier and the replica;

varying the amplitude of one of the carrier and the replica;

comparing the carrier and the replica to find a minimum difference in amplitude; and terminating said varying step when the minimum difference is found.

5. Apparatus for testing and adjusting audio equipment in an acoustic environment, said apparatus comprising:

a microphone for converting sound into an electrical signal, wherein the sound includes an audible carrier and an inaudible replica of said carrier modulated onto said carrier;

a compensating circuit coupled to said microphone for testing said acoustic environment by comparing said carrier with said replica and producing a control signal indicative of said comparison;

an equalizer coupled to said compensating circuit and responsive to said control signal by adjusting the amplitude vs. frequency characteristics of said equalizer.

6. The apparatus as set forth in claim 5 wherein said microphone is coupled to said demodulator by a wireless link.

7. The apparatus as set forth in claim 5 wherein said microphone includes a switch for causing said microphone to transmit a signal for initiating the test.

8. The apparatus as set forth in claim 5 wnerein said audio equipment includes a tone control circuit ahead of said equalizer.

9. The apparatus as set forth in claim 5 wherein said compensating circuit includes:

means for minimizing the phase difference between the carrier and the replica; and means for comparing the amplitude of the carrier with the amplitude of the replica and producing said control signal indicative of the difference in amplitudes.

10. The apparatus as set forth in claim 9 wherein said means for minimizing the phase difference includes at least one all-pass filter having a frequency-dependent phase shift.

* * * * *